United States Patent [19]

Satoh et al.

[11] 4,263,987

[45] Apr. 28, 1981

[54] CONTROL APPARATUS FOR ELEVATOR SYSTEM

[75] Inventors: Tsuyoshi Satoh; Kenzo Tachino, both of Inazawa, Japan

[73] Assignee: Mitsubishi Denki Kabushiki Kaisha, Inazawa, Japan

[21] Appl. No.: 37,163

[22] Filed: May 8, 1979

[30] Foreign Application Priority Data

Jun. 12, 1978 [JP] Japan ..... 53-70551

[51] Int. Cl.[3] ..... B66B 5/02

[52] U.S. Cl. ..... 187/29 R

[58] Field of Search ..... 187/29; 318/466, 467, 318/470, 489

[56] References Cited

U.S. PATENT DOCUMENTS

| | | | |
|---|---|---|---|
| 4,068,741 | 1/1978 | Ficheux et al. | 187/29 |
| 4,101,007 | 7/1978 | Magee | 187/29 |
| 4,114,731 | 9/1978 | Faup et al. | 187/29 |
| 4,128,142 | 12/1978 | Satoh et al. | 187/29 |

*Primary Examiner*—S. J. Witkowski
*Assistant Examiner*—W. E. Duncanson, Jr.
*Attorney, Agent, or Firm*—Oblon, Fisher, Spivak, McClelland & Maier

[57] ABSTRACT

A control apparatus for elevator system comprises a direction command device which outputs an ascending command signal or a descending command signal for a cage of an elevator; a driving signal generating device which outputs an ascending driving signal or a descending driving signal depending upon a driving direction of the cage of the elevator and a driving distance; and a detecting comparator which detects the ascending driving signal during non-output of the ascending command signal, and detects the descending driving signal during non-output of the descending command signal and outputs a command signal when the ascending driving signal or the descending driving signal is increased over a predetermined value.

6 Claims, 4 Drawing Figures

CONTROL APPARATUS FOR ELEVATOR SYSTEM

BACKGROUND OF THE INVENTION

1. Field of the Invention

The present invention relates to a control apparatus for elevator system which detects an abnormal driving state of a cage to output an emergency stop command signal.

2. DESCRIPTION OF PRIOR ARTS

In usual, a cage of an elevator is driven by a speed pattern signal and a driving direction command signal corresponding to a distance to the floor at a calling under receiving the calling signal.

When the cage is driven to the direction opposite to the calling direction, that is, the opposite direction to the direction of the driving command signal or a command speed pattern is not output even though the driving direction command is output or a braking of a motor is not released even though the driving direction command is not output, there is a possibility to start a cage under a balance of a weight of the cage and a counter-weight is lost. (Such state will be referred to as abnormal driving state). Such state is remarkably dangerous. The cage of the elevator should be stopped by an emergency stop.

FIG. 1 shows a block diagram of an abnormal driving state detecting mechanism in the conventional elevator system.

In FIG. 1, a cage (10) for an elevator (hereinafter referring to as a cage) is held in a hoistway (12) and is suspended by a wire rope (14). The wire rope (14) is hung on a traction sheave (18) connected directly a shaft of a traction motor (16). A counter-weight (20) is bound at the other end of the wire rope (14). A speed tachometer (22) is driven by a timing belt (24) hung on the traction sheave (18) and outputs a cage speed voltage (26) having (−) polarity in the ascending driving of the cage (10) and outputs one having (+) polarity in the descending driving, in proportional to a speed of the cage. A driving direction commanding device (28) receives a calling signal (30) and a cage position signal (32) to output an ascending command signal (28*a*) or a descending command signal (28*b*) during the driving. A command speed pattern generator (34) receives an output of the driving direction commanding device (28) to output a command speed voltage (36) having (+) polarity in the output of the ascending command signal (28*a*) (logical value "1") and one having (−) polarity in the output of the descending command signal (28*b*) (logical value "1") to a motor driving control circuit (38). The motor driving control circuit (38) inputs a cage speed voltage (26) and a command speed voltage (36) whereby the rotary speed of the traction motor (16) is controlled so as to drive the cage (10) at the speed commanded by the command speed pattern generator (34). An adder (40) adds the cage speed voltage (26) to the command speed voltage (36). An absolute value amplifier (42) always amplifies the output of the adder (40) to (+) voltage. A reference voltage generator (44) generates a predetermined reference voltage (46). A voltage comparator (48) compares the output voltage of the absolute value amplifier (42) with the reference voltage (46) to output when the output voltage of the absolute value amplifier (42) is greater.

During the normal driving state, the polarity of the command speed voltage (36) is opposite to that of the cage speed voltage (26). Accordingly, certain voltage caused by a time lag of the driving system is given in the output of the adder (40). The voltage is amplified to the voltage having (+) polarity by the absolute value amplifier (42). In the reference voltage generator (44), a reference voltage (46) which is greater than a maximum differential voltage between the command speed voltage (36) and the cage speed voltage (26) in the normal driving state, is previously set. Accordingly, an output is not generated from the voltage comparator (48) in the normal driving state.

When the cage is driven to the direction opposite to the output pattern of the command speed pattern generator (34), the polarity of the command speed voltage (36) is the same as that of the cage speed voltage (26). Both voltages are added in the adder (40). The output of the absolute value amplifier (42) is increased over the reference voltage (46) whereby the voltage comparator (48) outputs.

When the cage is started by certain fault, in spite of zero of the output of the command speed pattern generator (34), the cage speed voltage (26) itself is the output of the adder (40). The output of the absolute value amplifier (42) is increased in proportional to the cage speed whereby the voltage comparator (48) outputs at the time over the reference voltage (46).

Thus, the abnormal driving state is detected by detecting the fact that the difference between the command speed voltage (36) and the cage speed voltage (26) being proportional to the practical speed of the cage is increased over a predetermined value in the conventional apparatus. Smaller predetermined value is desirable. However, the predetermined value should be high enough not to detect it in the normal driving state because of fluctuation of the time lag element of the control system in the driving zone. Accordingly, there has been a disadvantage to be difficult detectng the abnormal driving state driving at slow speed as a falling or a rising in the unbalance between the cage and the counter-weight.

SUMMARY OF THE INVENTION

It is an object of the present invention to provide a control apparatus for elevator system which detects and abnormal driving state such as a reverse driving, a slip descending and a slip ascending in speedy without failure regardless of speed condition of a cage to result an emergency stop.

Figure 1:
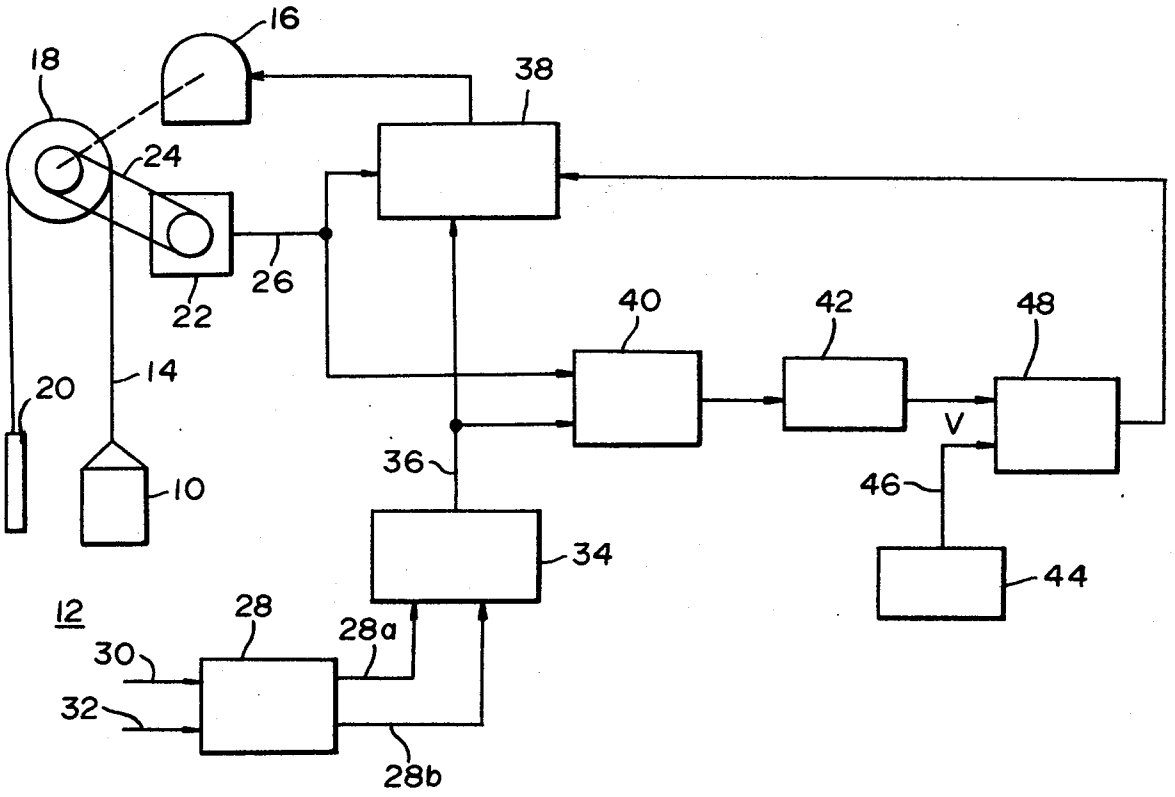
FIG. 1 is a diagram for illustrating a mechanism of the conventional control apparatus.
Figure 2:
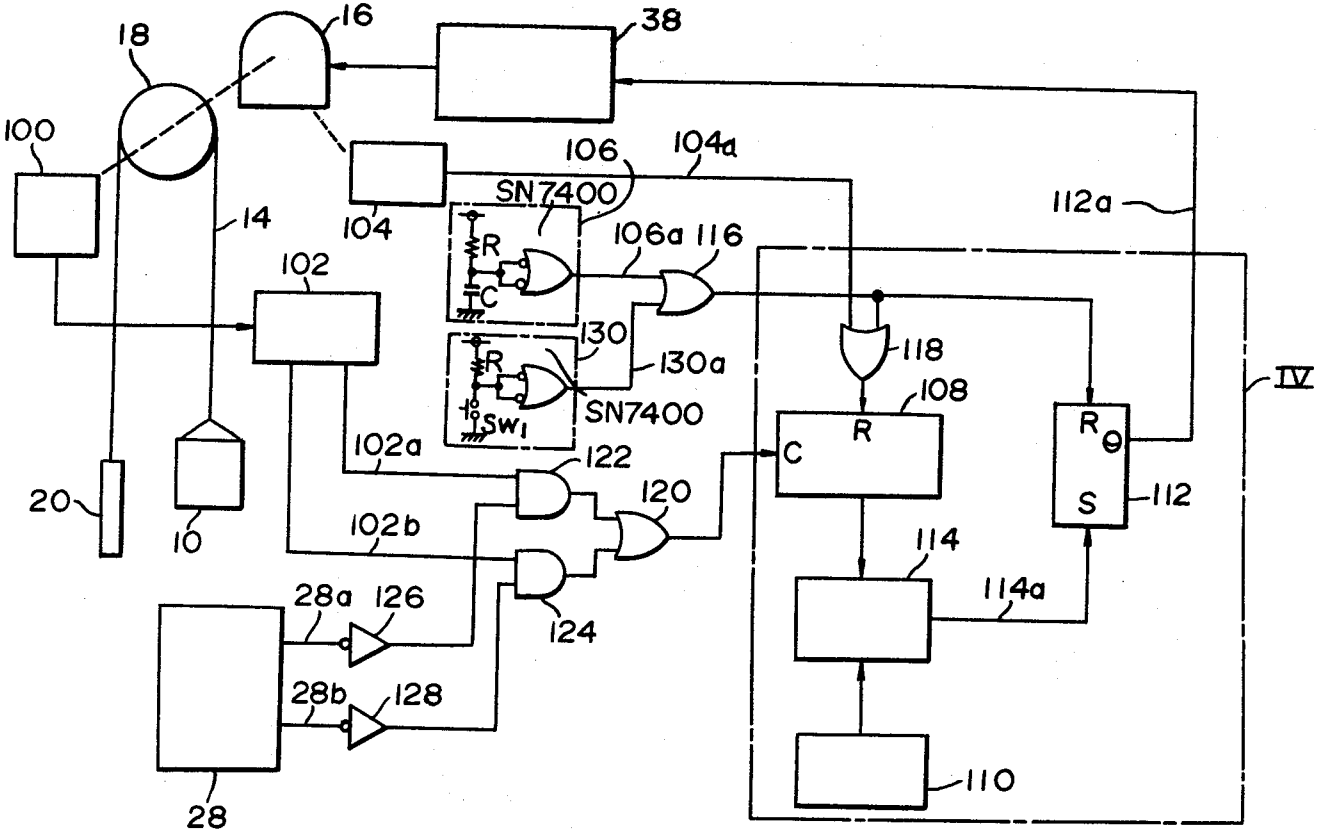
FIGS. 2, 3 and 4 are respectively diagrams for illustrating certain embodiments of the control apparatus of the present invention.
Figure 3:
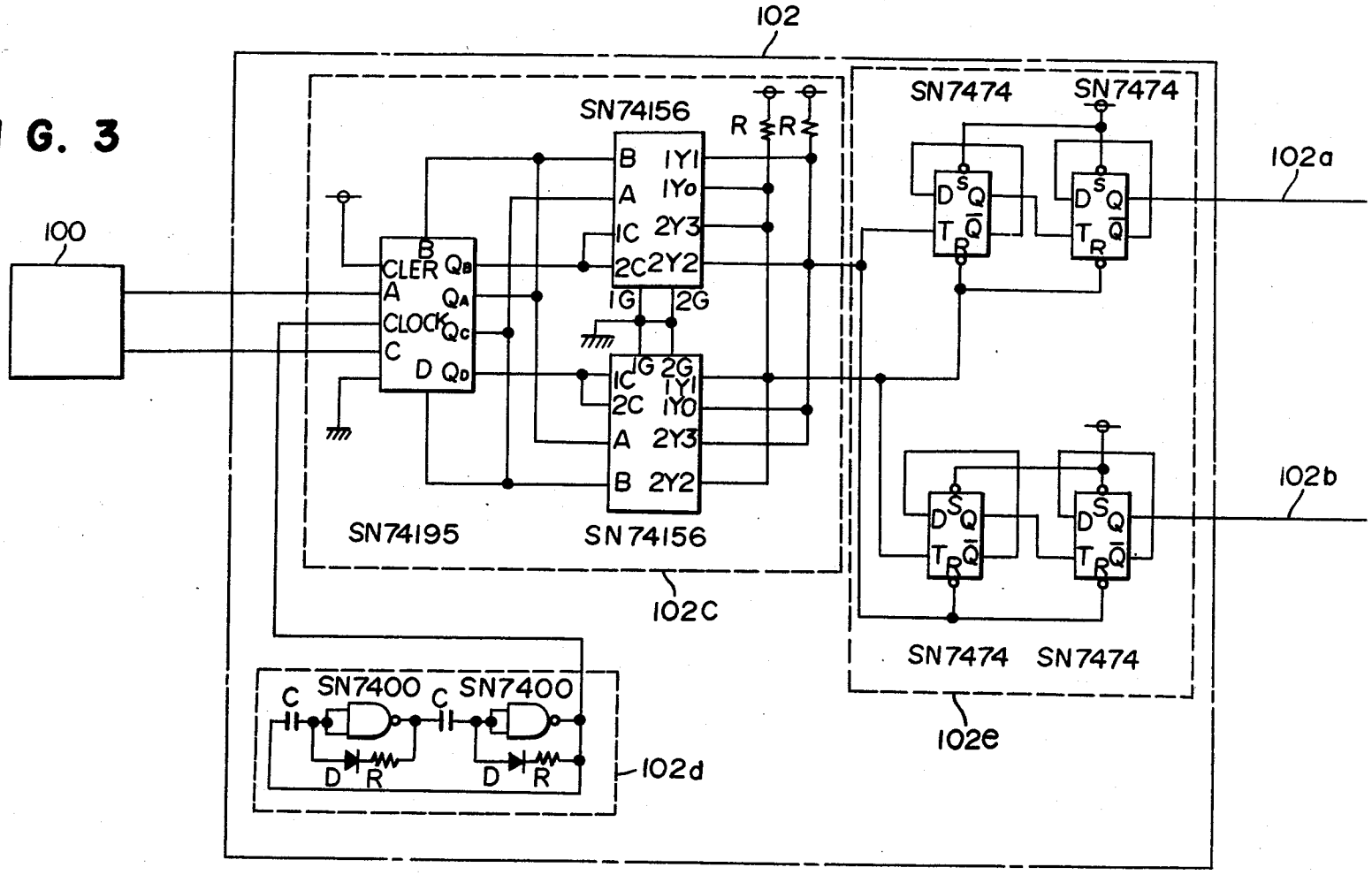

DETAILED DESCRIPTION OF THE PREFERRED EMBODIMENTS:

Certain embodiments of the present invention will be illustrated referring to FIGS. 1, 2 and 3 wherein same references designate identical or corresponding parts.

A pulse generator (100) is connected directly or through a belt to a traction sheave (18) and generates pulse having pulse numbers being proportional to a distance moving of the cage (10) (herein a distance per pulse is 10 mm) as two phase pulse signal output having a phase difference.

A direction discriminator (102) discriminates and outputs, the output pulse of the pulse generator (100) into an ascending pulse (102*a*) during driving upwardly and a descending pulse (102*b*) during driving downwardly. The direction discriminator (102) comprises a circuit (102*c*) for detecting the driving direction by a shifted phase of the two phase pulse signal generated from the pulse generator (100) (described in "Electronic Design 20, Sept. 27, 1973 page 112") and an oscillation circuit (102*d*) which generates frequency having more than 8 times of the maximum frequency generated from the pulse generator (100) and outputs as a sampling pulse signal to said circuit (102*c*) and a two step D type flip-flop circuit (102*e*) which divides the output pulse of the circuit (102*c*) into four divided frequencies and generates outputs (102*a*), (102*b*) having frequency being equal to output pulse frequency of the pulse signal of the pulse generator.

The circuit (102*c*) comprises SN 74195 (4 bit parallel-access shift registers; IC manufactured by Texas Instruments Incorporated) and two of SN 74156 (Dual 2-line-to-4-line decoders/demultiplexers; IC manufactured by Texas Instruments Incorporated). The oscillation circuit (102*d*) comprises two of SN 7400 (Quadruple 2 input positive NAND gates; IC manufactured by Texas Instruments Incorporated) and two capacitors (C), two diodes (D) and two resistors (R). The D type flip-flop circuit (102*e*) comprises 4 of SN 7474 (Dual D-type positive-edge-triggered flip-flops with present and clear; IC manufactured by Texas Instruments Incorporated).

Figure 4:
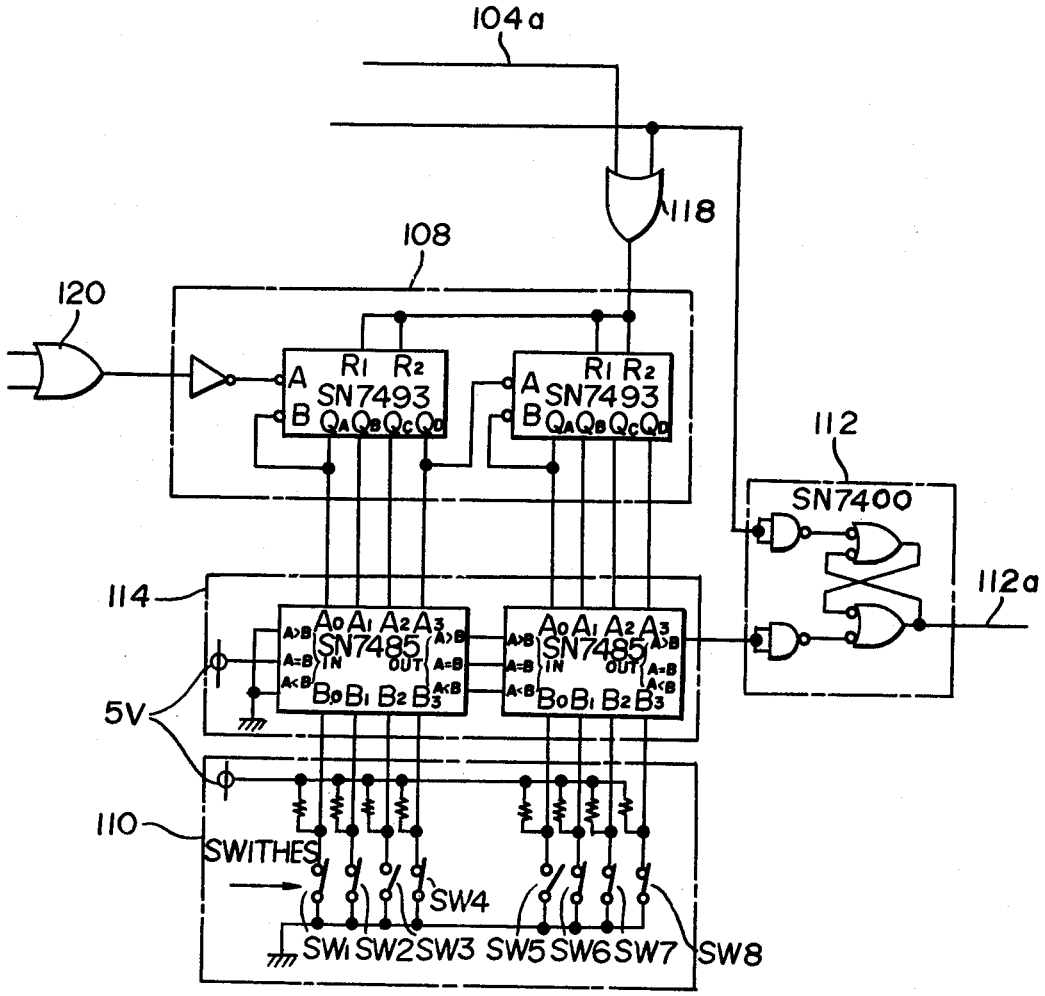

A braking detector (104) detects condition of the brake equipped to the traction motor (16) and outputs a braking signal (104*a*) during the time braking. A power source initial reset signal generator (106) outputs an initial reset signal (106*a*) during a small time for rising time of the power source fed to the elevator control circuit. The power source initial reset signal generator (106) comprises a resistor (R), a capacitor (C) and SN 7400 (NAND gate; IC manufactured by Texas Instruments Incorporated). A counter (108) equips reset input R and comprises two of SN 7493 connected in series (4 bit binary counter; IC manufactured by Texas Instruments Incorporated). A constant setter (110) sets a value corresponding to the output pulse numbers of the pulse generator (100) for a predetermined distance and comprises 8 of switches ($SW_1$) . . . ($SW_8$). In these embodiments, the set value is 20 and the switches ($SW_3$), ($SW_5$) are opened and the other switches are closed to give binary data. A flip-flop (112) equips set input S and reset input R. During the set state, it outputs the emergency stop command signal (112*a*) to a motor driving control circuit (38) and comprises SN 7400 (NAND gate; IC manufactured by Texas Instruments Incorporated). A comparator (114) compares the output of the counter (108) with the output of the constant setter (110) and outputs the set signal (114*a*) to the set input S of the flip-flop (112) at the time increasing the output of the counter (108) over that of the constant setter (110) and comprises two of SN 7485 connected in parallel (4 bit magnitude comparator; IC manufactured by Texas Instruments Incorporated). A hand operated reset signal generator (130) includes a switch for generating hand operated reset signal (130*a*) for resetting the counter (108) and the flip-flop (112) by hand operation and comprises a resistor (R), a switch ($SW_9$) and SN 7400 (NAND gate; IC manufactured by Texas Instruments Incorporated). The references (116), (118), (120) designate respectively OR gates. The OR gate (116) inputs the initial reset signal (106*a*) and the hand operated reset signal (130*a*) and the output of the OR gate (116) is fed to the OR gate (118) and the reset input (R) of the flip-flop (112). The braking signal (104*a*) is input as the other input of the OR gate (118) and the output of the OR gate (118) is fed to the reset input R ($R_1$, $R_2$, $R_3$, $R_4$ in FIG. 4) of the counter (108). The references (122), (124) designate respectively AND gates and (126), (128) designate respectively inverters to which the ascending command signal (28*a*) and the descending command signal (28*b*) as the driving direction command device (28) are respectively input. The outputs of the inverters (126), (128) are respectively fed to the inputs of the AND gates (122), (124). The ascending pulse (102*a*) and the descending pulse (102*b*) as the outputs of the direction discriminator (102) are respectively fed to the other inputs of the AND gates (122), (124). The input of the OR gate (120) is received from the AND gates (122), (124) and the output is fed to the counting input C of the counter (108).

The operation of the apparatus will be illustrated.

When the power is fed to the control circuit for elevator system, the initial reset signal (106*a*) is generated from the power source initial reset signal generator (106). The signal is passed through the OR gate (116) to reset the counter (108) and the flip-flop (112). When the cage is stopped, the traction motor (16) is braked to output the braking signal (104*a*) from the braking detector (104). The braking signal (104*a*) is passed through the OR gate (118) to reset the counter (108). When the brake is released to be driving state, the reset of the counter (108) is released to be capable of counting.

The driving direction command device (28) outputs the ascending command signal (28*a*) (logical level "1") during ascending operation whereby the output of the inverter (126) has logical level "0". The AND gate (122) is closed. The ascending pulse output from the direction discriminator (102) can not pass through the AND gate (122). During the descending operation, the descending command signal (28*b*) maintain the logical level "1" whereby the output of the inverter (128) has the logical level "O". The descending pulse (102*b*) output from the direction discriminator (102) can not pass through the AND gate (124). Accordingly, as far as the cage (10) drives in the normal state to the direction given by the driving direction command device, the pulse is not output from the AND gate (122), (124) and accordingly, the counting is not performed by the counter (108).

However, the cage is driven to the direction opposite to the command direction of the driving direction command device (28) by certain reason, the counting is performed by the counter (108).

That is, when the cage (10) descends even though the ascending command signal (28*a*) is output, the descending pulse (102*b*) passes through the AND gate (124) and OR gate (120) to the counter (108) because the AND gate (124) is opened. When the pulse numbers counted by the counter (108) increase over the predetermined pulse numbers set by the constant setter (110), the comparator (114) outputs to set the flip-flop (112) and the emergency stop command signal (112*a*) is output from the output Q of the flip-flop. The motor driving control circuit (38) receives the output whereby the feeding of the current to the traction motor (16) is stopped and simultaneously, the brake is actuated to result emergency stop of the cage.

When the ascending operation is performed in spite of output of the descending command signal (28*b*), the ascending pulse (102*a*) passes through the AND gate (122) and the OR gate (120) to input it into the counter (108) because the AND gate (122) is opened. The flip-flop (112) is set by the output of the comparator (114) which is output at the time increasing the output of the counter (108) over the output of the constant setter (110) whereby the emergency stop command signal (112*a*) is output from the output Q of the flip-flop (112).

When the driving direction command device (28) does not output the signal i.e. non-directional command, both of the AND gates (122), (124) are opened. Accordingly, the ascending pulse (102*a*) and the descending pulse (102*b*) can be passed through them. The counting of the counter (108) is performed regardless of the direction for driving the cage. At the time increasing the output of the counter (108) over the output of the constant setter (110), the emergency stop command signal (112*a*) is output from the output Q of the flip-flop (112), as well as the descending operation.

As described, the counting of the counter (108) is not performed as far as driving the cage to the direction given by the driving direction command device (28). However, in the practical operation certain dead time is caused by the weighing time of a weighing device (not shown) which varies torque of the traction motor (16) and the time lag of the driving system before starting the cage (10) by releasing the brake at the initiation of the driving. Therefore, there is a possibility that the cage is driven to the direction opposite to the driving command direction because of break of balance between the cage (10) and the counter-weight (20). When the cage is landed at the calling floor, there is a possibility that the cage (10) is vertically vibrated because of the transmitting characteristics of the driving system. In said case the counting of the counter (108) is slightly performed. Accordingly, the value setting in the constant setter (110) should be far larger than the counted value of the counter. (In this embodiment, it is set to 20 of the counting for the distance of 200 mm). The counted value is accumulated in each driving operation. Accordingly, the accumulation is prevented by resetting the counter (108) by the braking signal (104*a*) generated during the stopping state.

When the flip-flop (112) is set by causing the abnormal driving state, the emergency stop command signal (112*a*) is maintained. The signal can be released by pushing the switch ($SW_9$) in the hand operated reset signal generator (130) to reset the flip-flop (112) by passing the resulting hand operated reset signal (130*a*) through the OR gate (118). The hand operated reset signal (130*a*) simultaneously reset the counter (108). Accordingly, the emergency stop command signal is not output except causing the next abnormal state and driving the cage for the distance set by the constant setter (110).

As described above, the embodiment of the present invention comprises the direction command device generating the ascending command signal and the descending command signal for the cage of the elevator system; the pulse generator for generating the pulse having pulse numbers proportional to the distance moving the cage; the direction discriminator which discriminates and outputs the ascending pulse during ascending the cage and the descending pulse during descending the cage; the counter for counting the ascending pulse during the time outputting no ascending command signal, and counting the descending pulse during the time outputting no descending command signal; and a comparator for outputting a signal when the output of the counter increases over a predetermined value, whereby the emergency stop command signal is given by the output of the comparator to result the emergency stop of the cage.

The embodiment further comprises the brake detector which detects the condition of the braking mechanism for mechanically stopping the traction motor of the cage and outputs the braking signal during the braking whereby the counter is reset by the braking signal.

In brief, in the embodiment of the present invention, the ascending pulse and the descending pulse being proportional to the distance moving the cage are generated and the pulses except the pulses for the driving direction command are counted by the counter and the emergency stop command signal is generated by detecting the fact increasng the output of the counter over the predetermined value. The movement of the cage against the driving direction command can be immediately detected regardless of speed of the cage.

In the embodiment, the braking signal (104*a*) is used as the reset signal for the counter (108). However, it is possible to reset the counter by a landing zone detecting signal in the modified embodiment comprising a landing level detector wherein a position detector is equipped in the cage and a pluality of detected elements for corresponding to numbers of floors are equipped to face the position detector during passing the cage through each of the landing zones in the ascending operation, so as to give a landing zone detection signal for detecting the position of the cage in the landing zone by the position detector. The landing level detector can be the conventional one wherein the switch equipped in the cage is turned by cams equipped in the hoistway at each landing zone or the other conventional one wherein plates equipped in the hoistway are detected by a detector equipped in the cage by photoelectric or magnetic means.

In the embodiments, the pulse generator (100) is driven under the direct connection or through a belt by the traction sheave (18). It is possible to drive it by a sheave of a governor. The similar advantageous result can be obtained.

In accordance with the present invention of the control apparatus for elevator system, the abnormal driving of the cage against the driving direction command is detected in speedy without failure to control the driving of the cage.

What is claimed is:

1. A control apparatus for an automatic elevator system, which comprises:

a driving direction command device for controlling the direction of movement of the cage of the elevator, which produces outputs of an ascending command signal and a descending command signal;

a driving signal generating device for indicating the direction and distance of the movement of the cage of the elevator which produces outputs of an ascending signal and a descending signal;

a detecting comparator for determining when the cage of the elevator is moving abnormally, including a first condition detector for detecting a first condition including the presence of the ascending signal during the absence of the ascending command signal and a second condition detector for detecting a second condition including the presence of the descending signal during the absence of the descending command signal, said detecting comparator producing an output of an abnormal condition signal when at least one of the first and second conditions continues for a predetermined interval.

2. A control apparatus according to claim 1 wherein said driving signal generating device comprises a pulse generator for generating a pulse being proportional to a driving distance of the cage of the elevator; and a direction discriminator which discriminates and outputs the pulse signal as an ascending pulse during ascending the cage of the elevator and as a descending pulse during descending the cage; and the detecting comparator comprises a counter for counting the ascending pulse or the descending pulse, and a comparator which outputs an output signal when the output of the counter is increased over a predetermined value.

3. A control apparatus according to claim 1 which further comprises a brake detector for a cage hoisting motor brake to reset the detecting comparator by a braking signal.

4. A control apparatus according to claim 1 which further comprises a landing zone detector for detecting the cage within a landing zone to reset the detecting comparator by a landing zone signal.

5. A control apparatus according to claim 1 wherein said first and second detectors further comprise logic means for detecting said first and second conditions.

6. A control apparatus according to claim 1 wherein the detecting comparator further comprises:

a first inverter with an input receiving the ascending command signal and an output;

a second inverter with an input receiving the descending command signal and an output;

a first AND gate with a first input connected to the output of said first inverter, a second input receiving the ascending signal and an output;

a second AND gate with a first input connected to the output of said second inverter, a second input receiving the descending signal and an output; and an OR gate with a first input connected to the output of said first AND gate, a second input connected to the output of said second AND gate and an output.

* * * * *